US006606800B2

(12) United States Patent
Anthes et al.

(10) Patent No.: US 6,606,800 B2
(45) Date of Patent: Aug. 19, 2003

(54) ELECTRIC HAIR TREATMENT APPLIANCE

(75) Inventors: Peter Anthes, Erbach (DE); Detlef Mattinger, Bickenbach (DE)

(73) Assignee: Wella AG, Darmstadt (DE)

( * ) Notice: Subject to any disclaimer, the term of this patent is extended or adjusted under 35 U.S.C. 154(b) by 0 days.

(21) Appl. No.: 09/936,473

(22) PCT Filed: Jan. 22, 2001

(86) PCT No.: PCT/EP01/00673

§ 371 (c)(1),
(2), (4) Date: Sep. 13, 2001

(87) PCT Pub. No.: WO01/52688

PCT Pub. Date: Jul. 26, 2001

(65) Prior Publication Data

US 2002/0157275 A1 Oct. 31, 2002

(30) Foreign Application Priority Data

Jan. 22, 2000 (DE) ..... 100 02 785

(51) Int. Cl.[7] ..... A45D 20/00

(52) U.S. Cl. ..... 34/96; 34/99; 34/283; 34/289; 132/212

(58) Field of Search ..... 34/283, 289, 524, 34/96, 97, 98, 99, 100; 132/212

(56) References Cited

U.S. PATENT DOCUMENTS 3,464,425 A * 9/1969 Gagliano ..... 132/9
4,256,127 A * 3/1981 Tsujimoto et al. ..... 132/9
4,292,985 A * 10/1981 Itogawa et al. ..... 132/9
4,352,248 A * 10/1982 Kobayashi ..... 34/88
4,766,913 A * 8/1988 Klein ..... 132/9
4,914,273 A * 4/1990 Matsui ..... 219/222
5,063,688 A 11/1991 Moll

FOREIGN PATENT DOCUMENTS

DE 42 36 751 A 5/1994
EP 0 072 994 A 3/1983

* cited by examiner

*Primary Examiner*—Ira S. Lazarus
*Assistant Examiner*—K. B. Rinehart
(74) *Attorney, Agent, or Firm*—Michael J. Striker

(57) ABSTRACT

The electrical hair treatment appliance (1) includes an electrically controlled hair treatment device, preferably including infrared emitter elements (20), and an operator control panel (2) rigidily attached to the hair treatment device. The operator control panel (2) includes a receptacle (5) rigidly attached to the hair treatment device, an operator control and display device (3) mounted in the receptacle (5) so as to rotate in the receptacle and an electrical connection (6) for electrically connecting between the operator control and display device (3) and the receptacle (5). The rotatable operator control and display device (3) preferably includes buttons for setting and adjusting operating parameters of the hair treatment device and has a circular face (4). The electrical connection (6) may include a flat cable (7), such as a stranded flat cable or a flexible electrical conductor track foil.

6 Claims, 4 Drawing Sheets

FIG. 5
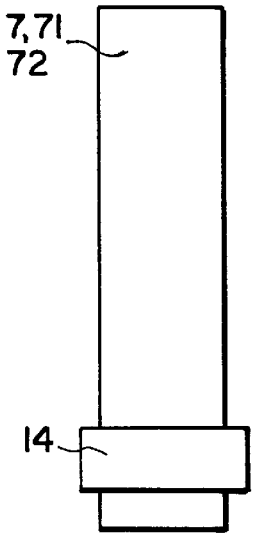
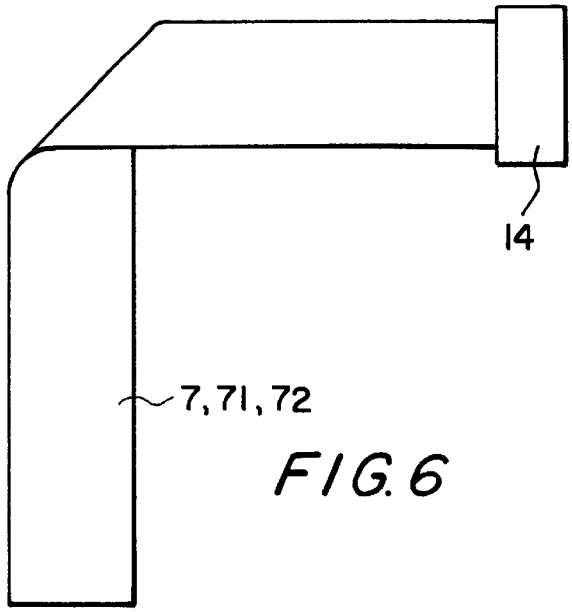
FIG. 6
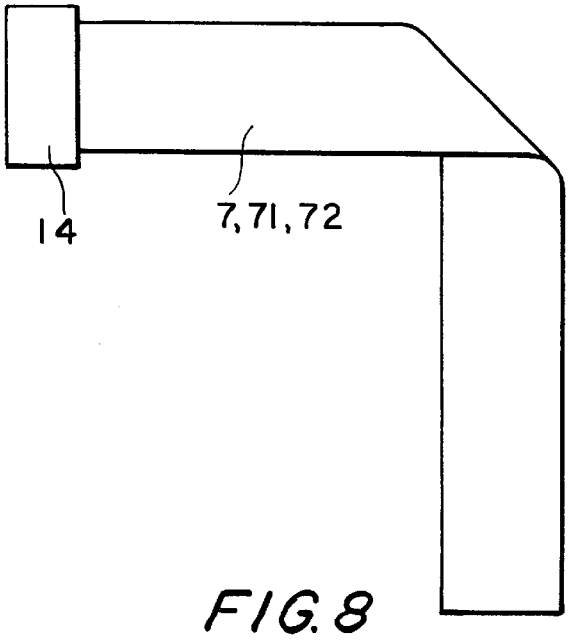
FIG. 8
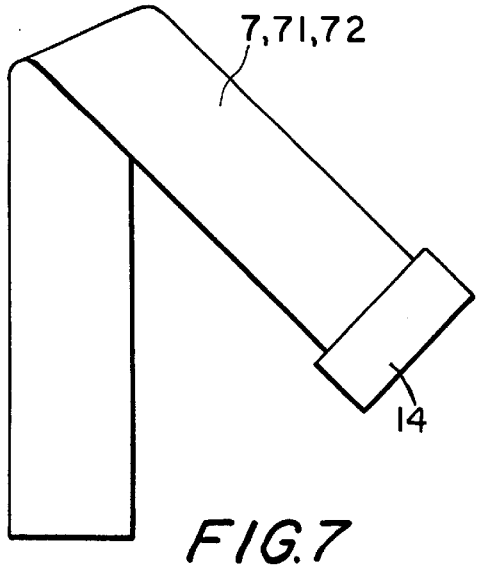
FIG. 7

ELECTRIC HAIR TREATMENT APPLIANCE

The invention relates to an electric hair treatment appliance as generically defined by the preamble to claim 1.

A hair treatment appliance defining this generic type is already from European Patent Disclosure EP 0 072 994 A1 of the present Applicant. A solidly connected operator control panel for controlling operating parameters is disposed on the back of this hair treatment appliance, and the operator control panel has a stationary operator control and display field. Because of this construction, this has the disadvantage that the operator control panel can be operated only from the back of the hair treatment appliance.

It is therefore the object of the invention to create a hair treatment appliance of this generic type which does not have this disadvantage and can be conveniently operated selectively from the sides of the hair treatment appliance as well.

This object is attained as defined by the body of claim 1. Further advantageous refinements of the invention are recited in the dependent claims.

Because the operator control and display field is embodied as a circular face and is embedded rotatably, surface-axially, in a receptacle of the operator control panel, operation of the operator control panel of the hair treatment appliance is possible selectively, depending on the manually set rotary position of the operator control and display field, from the back or from both sides. For instance, if the hair treatment appliance is positioned in a tight corner of a hairdressing salon, it is conveniently possible to operate the operator control panel from the side accordingly.

The invention will be explained in further detail in terms of an exemplary embodiment.

Figure 1:
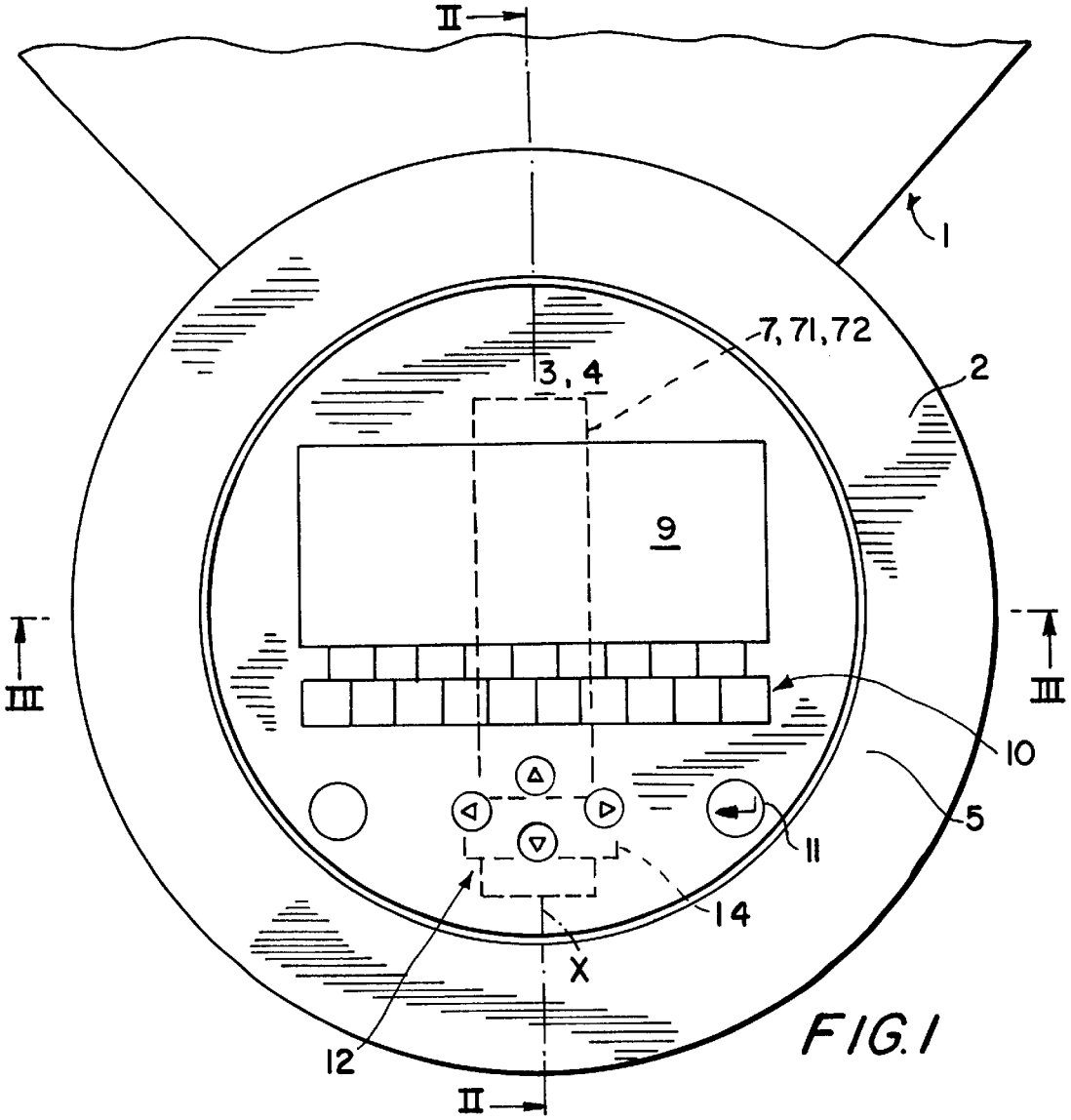
Figure 2:
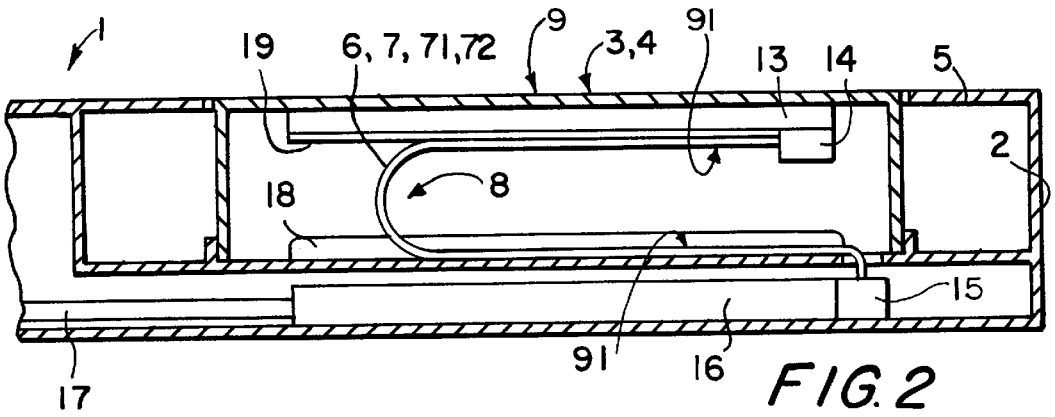
Figure 3:
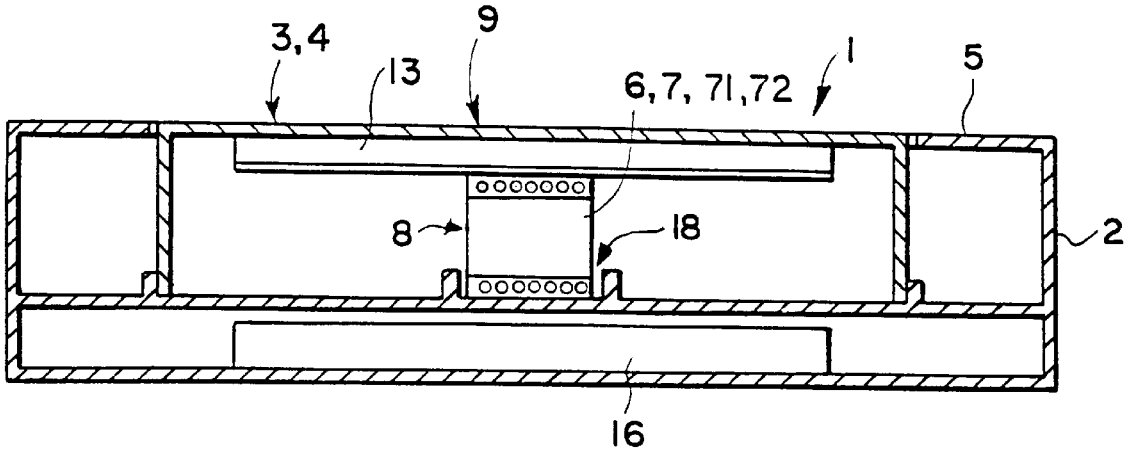
Figure 4:
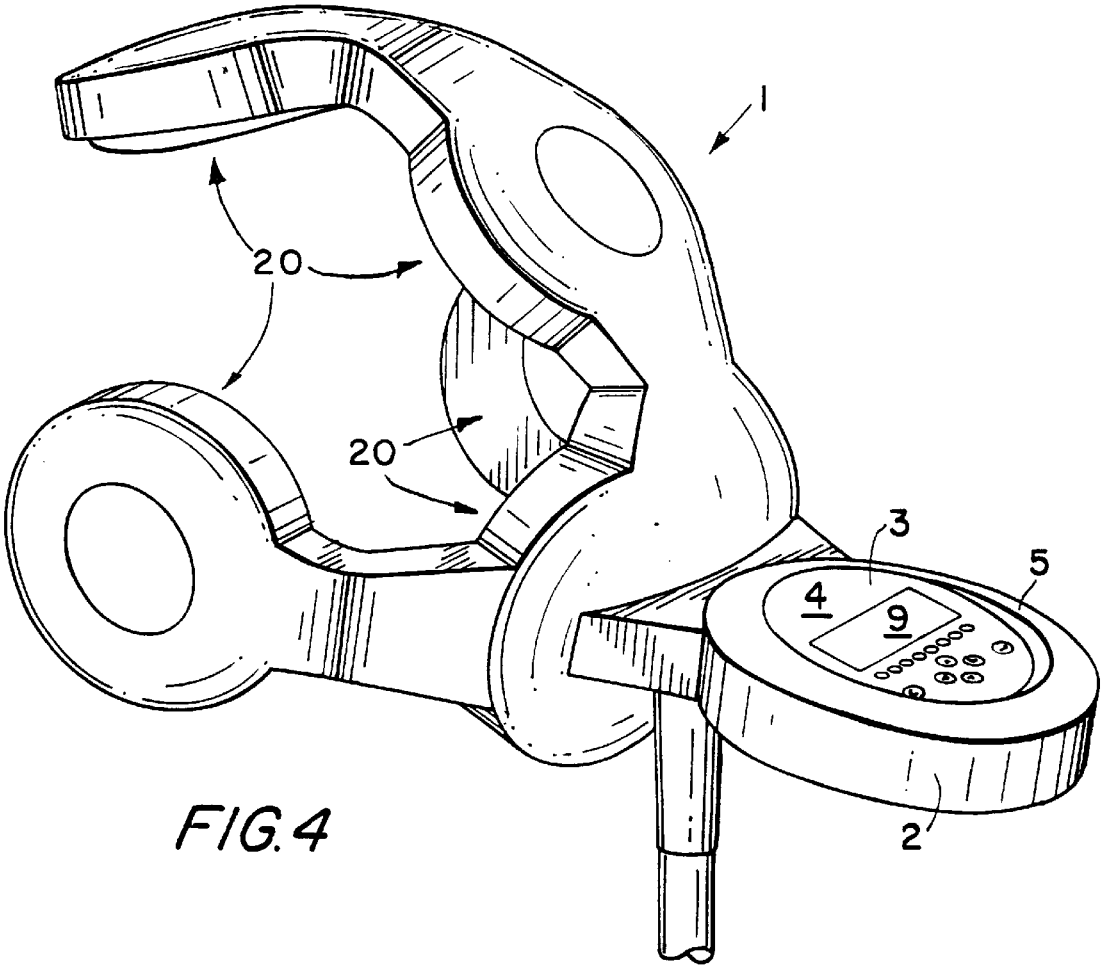
Figure 9:
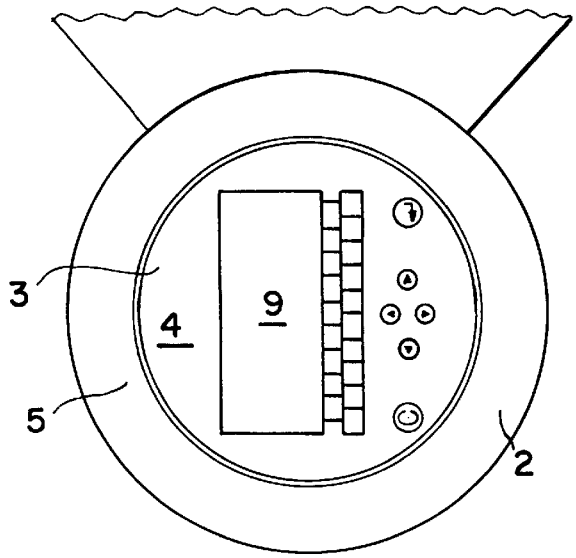
Figure 10:
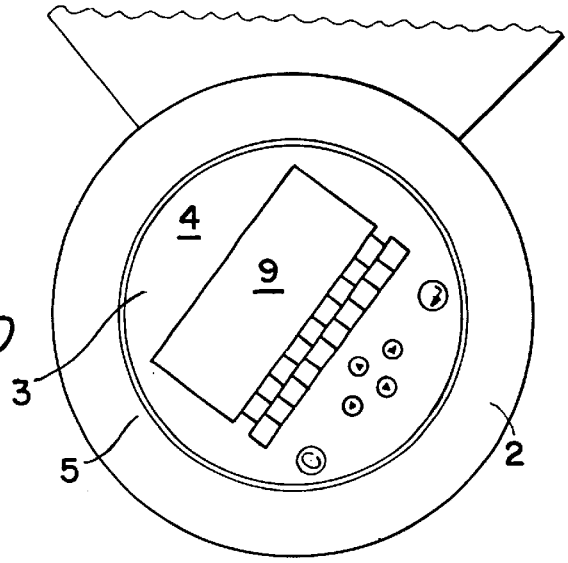
Figure 11:
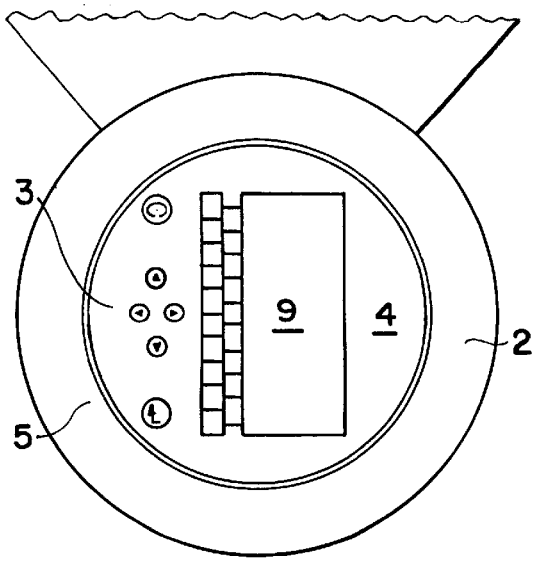

Shown are:

FIG. 1, in a plan view, an operator control and display field with a receptacle;

FIG. 2, in a sectional view, a section taken along the line II—II of FIG. 1;

FIG. 3, in a sectional view, a section taken along the line III—III of FIG. 1;

FIG. 4, in a perspective view, a hair treatment appliance with the operator control and display field;

FIGS. 5–8, various positions of a flat cable as a function of the angular position of the operator control and display field; and FIGS. 9–11, various angular positions of the operator control and display field.

FIG. 1 shows part of an electric hair treatment appliance 1, with a operator control panel 2 solidly connected to the hair treatment appliance 1 for controlling operating parameters, and the operator control panel 2 has an operator control and display field 3. The operator control and display field 3 is embodied as a circular face 4 and is axially rotatable with the circular face 4 into arbitrary angular positions in a receptacle 5. For inputting and controlling operating parameters, the operator control and display field 3 is provided with a display 9, a plurality of input buttons 10, 11, and a plurality of cursor buttons 12.

In FIG. 2, the section II—II of FIG. 1 is shown; the operator control panel 2 for adjusting the electrical operator control and display field 3 into an arbitrary angular position is shown in more detail here. The operator control and display field 3 is preferably embodied as rotatable outward from the middle angular position X by at least +/− 90°. Within the scope of familiar professional provisions, suitable rotary stops (not otherwise shown) should be provided, along with a suitable rotary bearing of the operator control and display field 3. As an electrical connection 6 between the receptacle 5 and the operator control and display field 3, a flat cable 7 is provided, which in FIG. 1, in a neutral middle angular position X of the operator control and display field 3, essentially forms a U-shaped loop 8 and which is disposed with its flat sides 9.1 between the receptacle 5 and the operator control and display field 3. A printed circuit board 13 with suitable components is disposed below the operator control and display field 3; one end of the flat cable 7, which for the sake of better flexibility is used in the form of a stranded flat cable 7.1 or a conductor track foil 7.2, is electrically connected to the printed circuit board 13 via a connection 14. The other end of the flat cable 7, 7.1 is electrically connected via a further connection 15 to a further printed circuit board 16, and from the printed circuit board 16, a cable 17 for electrical functions leads out into the hair treatment appliance 1. The lower part of the flat cable 7, 7.1 or conductor track foil 7.2 is held and guided against any slippage by a groove 18. To minimize friction of the upper part of the flat cable 7, 7.1, the lower side of the printed circuit board 13 is provided with a slip foil 19.

FIG. 3 shows a section III—III from FIG. 1, and FIG. 4 shows the hair treatment appliance 1 for a hairdressing salon; it is capable of outputting a controlled emission of heat and a selective flow of heat for treating hair on a person's head. Instead of elongated infrared emitter elements as in EP 0 072 994 A1 (FIGS. 1 and 5), here circular infrared emitter elements 20 (FIG. 4) with a selective heat flow are provided.

In FIGS. 5–8, various positions of the flat cable 7, 7.1, 7.2 are shown, depending on the angular position of the operator control and display field 3. The position in FIG. 5 is equivalent to the neutral angular position X of FIG. 1. The position of FIG. 6 corresponds to the angular position (90°) of FIG. 9. The position of FIG. 7 corresponds to the angular position (45°) of FIG. 10. The position of FIG. 8 corresponds to the angular position (90°) of FIG. 11.

List of Reference Numerals

| | |
|---|---|
| 1 | Hair treatment appliance |
| 2 | Control panel |
| 3 | Control and display field |
| 4 | Circular face |
| 5 | Receptacle |
| 6 | Connection |
| 7 | Flat cable |
| 7.1 | Stranded flat cable |
| 7.2 | Conductor track foil |
| 8 | Loop |
| 9 | Display |
| 9.1 | Flat side |
| 10, 11 | Input buttons |
| 12 | Cursor buttons |
| 13 | Printed circuit board |
| 14 | Connection |
| 15 | Connection |
| 16 | Printed circuit board |
| 17 | Cable |
| 18 | Groove |
| 19 | Slip foil |
| 20 | Infrared emitter element |

What is claimed is:

1. An electrical hair treatment appliance (1) comprising:

electrically controlled means for treating hair; and an operator control panel (2) rigidily attached to said electrically controlled means for treating hair;

wherein said operator control panel (2) includes a receptacle (5) rigidly attached to said electrically controlled means for treating hair, an operator control and display device (3) mounted in said receptacle (5) so as to rotate in said receptacle and means (6) for electrical connection between said operator control and display device (3) and said receptacle (5), and wherein said operator control and display device (3) comprises means (9,10,11,12) for setting and adjusting operating parameters of said electrically controlled means for treating hair and said operator control and display device (3) has a circular face (4).

2. The electrical hair treatment appliance (1) as defined in claim 1, wherein said operator control and display device (3) has a middle angular position (X) in said receptacle (5), and wherein said means (6) for electrical connection comprises a flat cable (7) arranged in a U-shaped loop (8) and said flat cable (7) has flat sides (91) arranged between said receptacle (5) and said operator control and display device (3), when said operator control and display device (3) is located in said middle angular position (X).

3. The electrical hair treatment appliance (1) as defined in claim 2, wherein said flat cable (7) is a stranded flat cable (71) or a flexible elastic conductor track foil (72).

4. The electrical hair treatment appliance (1) as defined in claim 1, wherein said operator control and display device (3) rotates over a 90° angular range from said middle angular position (X) in either of two opposite rotation directions.

5. The electrical hair treatment appliance (1) as defined in claim 1, wherein said electrically controlled means for treating the hair comprises means for heating the hair.

6. The electrical hair treatment appliance (1) as defined in claim 5, wherein said means for heating the hair comprises a plurality of infrared emitter elements (20).

* * * * *